US011459667B2

(12) United States Patent
Sato

(10) Patent No.: US 11,459,667 B2
(45) Date of Patent: Oct. 4, 2022

(54) FILM FORMING APPARATUS FOR FORMING METAL FILM

(71) Applicant: TOYOTA JIDOSHA KABUSHIKI KAISHA, Toyota (JP)

(72) Inventor: Yuki Sato, Nagoya (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 42 days.

(21) Appl. No.: 16/841,801

(22) Filed: Apr. 7, 2020

(65) Prior Publication Data

US 2020/0340134 A1 Oct. 29, 2020

(30) Foreign Application Priority Data

Apr. 26, 2019 (JP) ..... JP2019-084847

(51) Int. Cl.
*C25D 17/00* (2006.01)
*C25D 11/00* (2006.01)

(52) U.S. Cl.
CPC ..... *C25D 11/005* (2013.01); *C25D 17/005* (2013.01)

(58) Field of Classification Search
None
See application file for complete search history.

(56) References Cited

U.S. PATENT DOCUMENTS

2005/0051437 A1* 3/2005 Kurashina ..... C25D 17/002 205/143
2005/0139482 A1* 6/2005 Nagai ..... H01L 21/2885 257/E21.585
2015/0014178 A1* 1/2015 Hiraoka ..... C25D 17/005 205/261
2019/0093247 A1 3/2019 Iisaka

FOREIGN PATENT DOCUMENTS

CN 109576746 A 4/2019
JP 2005163085 A 6/2005
JP 2017088918 A 5/2017
KR 101669803 B1 * 10/2016 ..... C25D 17/06
KR 101669803 B1 10/2016

* cited by examiner

*Primary Examiner* — Stefanie S Wittenberg
(74) *Attorney, Agent, or Firm* — Dickinson Wright, PLLC

(57) ABSTRACT

Provided is a metal film forming apparatus capable of forming a uniform metal film on a surface of a substrate by uniformly pressurizing an electrolyte membrane against the surface of the substrate. The film forming apparatus includes first and second film forming units, a coupling portion that couples the first and second film forming units together, a pressure device including a pressure unit that pressurizes substrates with electrolyte membranes of the respective film forming units via the coupling portion, and a power supply unit adapted to apply a voltage across each anode and each substrate. The film forming units are coupled to the coupling portion via their respective first elastic bodies that elastically deform in the pressurization direction of the pressure unit.

2 Claims, 6 Drawing Sheets

FILM FORMING APPARATUS FOR FORMING METAL FILM

CROSS REFERENCE TO RELATED APPLICATIONS

The present application claims priority from Japanese patent application JP 2019-084847 filed on Apr. 26, 2019, the content of which is hereby incorporated by reference into this application.

BACKGROUND

Technical Field

The present disclosure relates to a film forming apparatus for forming a metal film on a surface of a substrate.

Background Art

Conventionally, a metal film is formed by depositing metal (by reducing metal ions) on a surface of a substrate. For example, JP 2017-88918 A proposes a film forming apparatus including an anode, an electrolyte membrane disposed between the anode and a substrate serving as a cathode, a liquid housing portion that houses a metal solution containing metal ions, and a power supply unit that applies a voltage across the anode and the substrate. The film forming apparatus further includes a pressure device that pressurizes the electrolyte membrane against the substrate. The liquid housing portion is attached to the pressure device via an elastic body that can elastically deform in the pressurization direction of the pressure device.

In such a film forming apparatus, when the electrolyte membrane is pressurized against the substrate, the elastic body elastically deforms in the pressurized direction of the substrate, and thus, the surface of the substrate can be pressurized with the electrolyte membrane due to a restoring force of the elastic body that has elastically deformed. At this time, the fluid pressure of the metal solution in the liquid housing portion increases due to a reaction force of the substrate acting on the electrolyte membrane. Consequently, the surface of the substrate can be uniformly pressurized with the electrolyte membrane due to the increased fluid pressure of the metal solution. In such a pressurized state, a voltage is applied across the anode and the substrate so that metal ions contained in the electrolyte membrane are reduced and a uniform metal film can thus be formed on the surface of the substrate.

SUMMARY

However, in the film forming apparatus according to JP 2017-88918 A, when metal films are concurrently formed on a plurality of portions of a substrate using a plurality of electrolyte membranes, for example, it may be impossible to uniformly pressurize the surface of the substrate with the electrolyte membranes. In particular, when the distance between each electrolyte membrane and the surface of the substrate before a pressure is applied thereto differs from one another, such a phenomenon becomes prominent. Consequently, it may be impossible to form a uniform metal film on a portion of the surface of the substrate in contact with each electrolyte membrane.

The present disclosure has been made in view of the foregoing, and provides a film forming apparatus for forming a metal film, capable of forming a uniform metal film on a surface of a substrate by uniformly pressurizing an electrolyte membrane against the surface of the substrate.

Accordingly, the film forming apparatus for forming a metal film according to the present disclosure is a film forming apparatus for forming a metal film on a surface of a substrate by (chemically) reducing metal ions, including a plurality of film forming units each including an anode, an electrolyte membrane disposed between the anode and the substrate, and a liquid housing portion having the electrolyte membrane attached thereto, the liquid housing portion being adapted to house a metal solution containing the metal ions such that the metal solution is sealed in the liquid housing portion and the metal solution is in contact with the electrolyte membrane; a pressure device including a coupling portion and a pressure unit, the coupling portion being adapted to couple the film forming units together, and the pressure unit being adapted to pressurize the substrates with the electrolyte membranes of the respective film forming units via the coupling portion; and a power supply unit adapted to apply a voltage across each anode and each substrate so that metal derived from the metal ions with which each electrolyte membrane is impregnated are deposited on a surface of the substrate in a state in which the electrolyte membrane of each film forming unit is in contact with the substrate, in which each film forming unit is coupled to the coupling portion via a first elastic body, the first elastic body being adapted to elastically deform in a pressurization direction of the pressure unit.

According to the present disclosure, when a metal film is formed on a surface of a substrate, the electrolyte membrane of each film forming unit is pressurized against the substrate by the pressure unit of the pressure device via the coupling unit. At this time, the first elastic body of each film forming unit, which is coupled to the coupling portion of the pressure device, elastically deforms in the direction of compression. Accordingly, the electrolyte membrane of each film forming unit can be independently displaced in the pressurization direction with respect to the single coupling portion. Consequently, even when the distance between each electrolyte membrane and the surface of each substrate differs from one another before a pressure is applied, for example, such a difference in the distance can be absorbed through elastic deformation of each first elastic body, so that the surface of each substrate can be uniformly pressurized with the electrolyte membrane of each film forming unit.

In this manner, when a voltage is applied across the anode of each film forming unit and each substrate by the power supply unit while the surface of the substrate is uniformly pressurized with the electrolyte membrane of each film forming unit, metal ions contained in the electrolyte membrane are reduced on the surface of the substrate. Accordingly, a uniform metal film can be formed on the surface of the substrate.

Further, in some embodiments, the electrolyte membrane is attached to the liquid housing portion via a second elastic body, the second elastic body being adapted to elastically deform in the pressurization direction, and the spring constant of the first elastic body in the pressurization direction is smaller than that of the second elastic body in the pressurization direction.

According to such an embodiment, since the spring constant of the first elastic body in the pressurization direction is smaller than that of the second elastic body in the pressurization direction, the first elastic body can be compressively deformed more than the second elastic body in each film forming unit when a pressure is applied. Consequently, when the distance between each electrolyte membrane and the surface of each substrate is different from one another before a pressure is applied, for example, such a difference in the distance can be absorbed through elastic deformation of each first elastic body. Further, the electrolyte membrane of each film forming unit can be allowed to uniformly follow the surface of each substrate through elastic deformation of the second elastic body.

Herein, the state of the pressure unit and the coupling portion attached together is not particularly limited as long as the pressure unit can pressurize the surface of each substrate with each electrolyte membrane via the coupling portion. However, in some embodiments, the coupling portion is pivotally attached to the pressure unit so that the coupling portion pivots when each first elastic body has elastically deformed in response to a pressure applied by the pressure unit.

According to such an embodiment, since the coupling portion is pivotally attached to the pressure unit, even when the distance between each electrolyte membrane and its corresponding substrate differs from one another, the coupling portion pivots by an amount corresponding to the difference in the distance, and thus, the amount of compressive deformation of each first elastic body can be made closer to each other. Accordingly, a pressure applied with the electrolyte membrane of each film forming unit can be made more uniform.

According to the present disclosure, it is possible to form a uniform metal film on a surface of a substrate by uniformly pressurizing an electrolyte membrane against the surface of the substrate.

DETAILED DESCRIPTION

Hereinafter, an embodiment according to the present disclosure will be described first with reference to FIGS. 1 to 4.

1. Regarding a Film Forming Apparatus 1

Figure 1A:
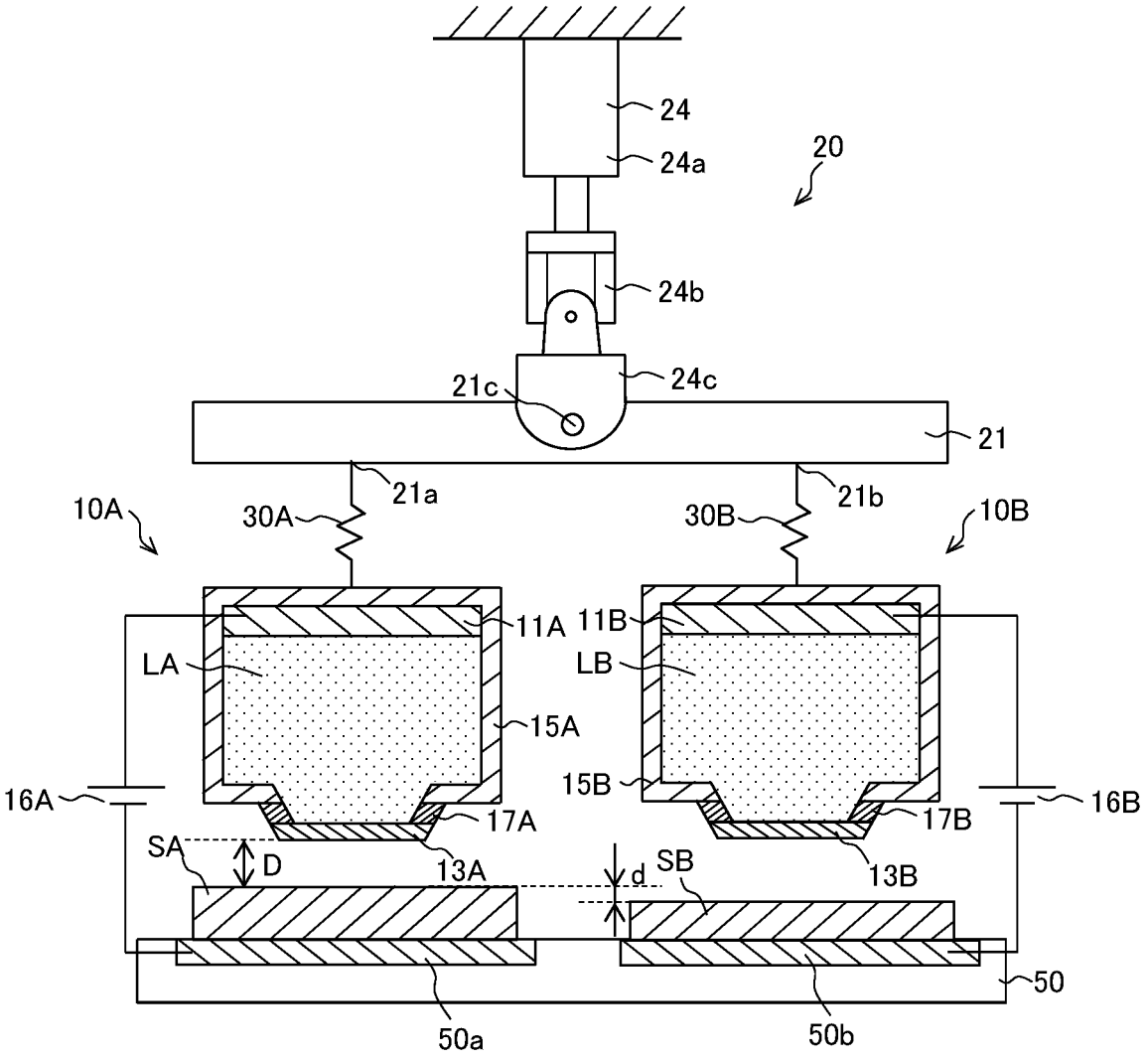
FIG. 1A is a schematic cross-sectional view of a film forming apparatus for forming a metal film according to a first embodiment of the present disclosure.
Figure 1B:
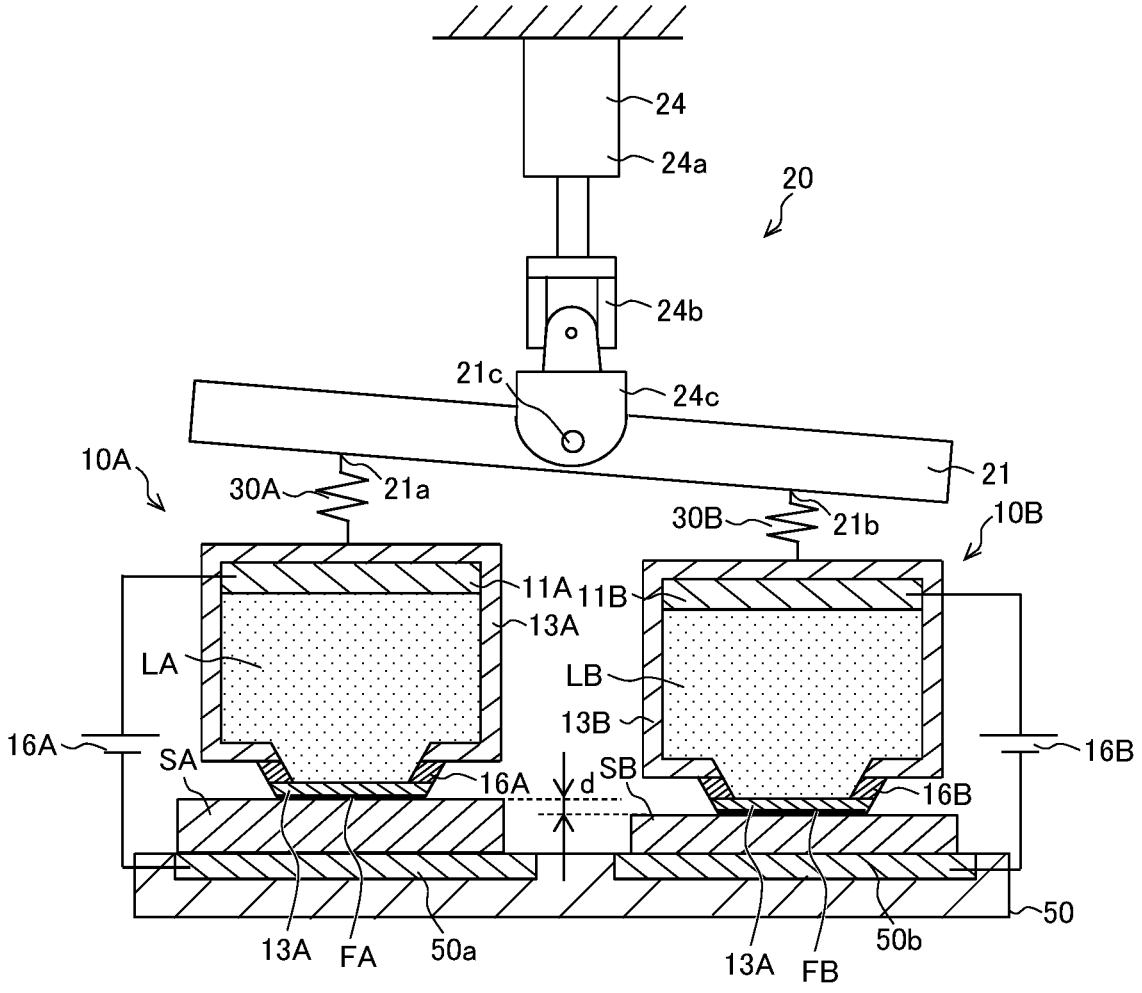
FIG. 1B is a schematic cross-sectional view for illustrating the state of a metal film formed using the film forming apparatus illustrated in FIG. 1A.

FIGS. 1A and 1B are schematic cross-sectional views of a film forming apparatus 1 for forming a metal film according to the first embodiment of the present disclosure. As illustrated in FIGS. 1A and 1B, the film forming apparatus 1 according to the first embodiment is a device that deposits metal by reducing metal ions and thus forms a metal film F of the deposited metal on a surface of at least one substrate (specifically, first and second substrates SA and SB in the present embodiment).

Each of the first and second substrates SA and SB on which a metal film is formed is not particularly limited as long as the surface of the substrate on which the film is formed functions as a cathode (i.e., an electrically conductive surface). Specifically, each of the first and second substrates SA and SB may be the one obtained by partially forming an electrically conductive portion, such as copper, nickel, silver, or iron, as a cathode on an insulating portion, such as polymer resin like epoxy resin, or ceramic. Each of the first and second substrates SA and SB may also contain a metallic material, such as aluminum or iron. In the present embodiment, metal films FA and FB are formed on respective surfaces of the first and second substrates SA and SB, using first and second film forming units 10A and 10B.

The present embodiment exemplarily illustrates a case where the first substrate SA is thicker than the second substrate SB to more clearly show the advantageous effects of the film forming apparatus 1 described below. Specifically, the distance between the first substrate SA and the first film forming unit 10A (specifically, an electrolyte membrane 13A) is shorter than the distance between the second substrate SB and the second film forming unit 10B (specifically, an electrolyte membrane 13B) in the pressurization direction described below. It should be noted that the first and second substrates SA and SB may also have the same thickness, and a metal film may also be formed on a surface of a single substrate using the first and second film forming units 10A and 10B.

In the present embodiment, the film forming apparatus 1 includes the first and second film forming units 10A and 10B. In the following, regarding the configurations of the first and second film forming units 10A and 10B, each component of the first film forming unit 10A will be described first, and each corresponding component of the second film forming unit 10B will be described with its reference numeral with parentheses added following the reference numeral for each component of the first film forming unit 10A, and so, the detailed description thereof will be omitted.

As illustrated in FIG. 1A, each film forming unit 10A (10B) includes an anode 11A (11B), an electrolyte membrane 13A (13B), and a liquid housing portion 15A (15B).

Each anode 11A (11B) is a block-like or plate-like anode that is insoluble in (i.e., does not dissolve in) a metal solution LA (LB) described below. Examples of such anode 11A (11B) include ruthenium oxide, platinum, and iridium oxide that are insoluble in the metal solution LA (LB). The anode 11A (11B) may also be a substrate made of copper or titanium and covered with the aforementioned metal.

The anode 11A (11B) may also be made of metal that is soluble in the metal solution LA (LB) and is of the same type as that of metal of a metal film FA (FB) to be formed on the substrate. For example, when the metal film FA (FB) is a copper film, the anode 11A (11B) is made of copper, while when the metal film FA (FB) is a nickel film, the anode 11A (11B) is made of nickel. It should be noted that the first and second film forming units 10A and 10B may form metal films FA and FB containing different types of metal. In such a case, the material of the anode 11A of the first film forming unit 10A and the material of the anode 11B of the second film forming unit 10B may be different metallic materials corresponding to the metal films FA and FB to be formed.

The electrolyte membrane 13A (13B) is disposed between the anode 11A (11B) and the substrate SA (SB). The electrolyte membrane 13A (13B) is not particularly limited as long as it can be impregnated with metal ions by contacting the metal solution LA (LB) containing the metal ions described below, and metal derived from the metal ions can be deposited on the surface of the substrate SA (SB) upon application of a voltage. Examples of the material of the electrolyte membrane 13A (13B) include fluorine-based resin, such as Nafion (registered trademark) produced by DuPont, hydrocarbon-based resin, polyamic acid resin, and resin with a cation exchange function, such as SELEMION (CMV, CMD, CMF series) produced by AGC Inc.

The liquid housing portion 15A (15B) houses the metal solution LA (LB), which contains the metal ions for forming a film, in a hermetically sealed manner, and the metal solution LA (LB) is in contact with the electrolyte membrane 13A (13B). In the present embodiment, the liquid housing portion 15A (15B) houses the metal solution LA (LB) containing the metal ions for forming a film. The material of the liquid housing portion 15A (15B) is not particularly limited as long as it is a corrosion-resistant material and can house the metal solution LA (LB). For example, metallic materials, such as stainless steel, can be used.

In the present embodiment, the anode 11A (11B) is disposed on one side within the liquid housing portion 15A (15B), and an opening 15*a* (15*b*) is formed on the other side. The electrolyte membrane 13A (13B) is attached to the liquid housing portion 15A (15B) via a second elastic body 17A (17B) so as to cover the opening 15*a* (15*b*). It should be noted that a first elastic body 30A (30B) of the film forming apparatus 1 will be described later.

The second elastic body 17A (17B) is adapted to elastically deform (i.e., compressively elastically deform) in the pressurization direction described below. In the present embodiment, for example, the second elastic body 17A (17B) is a sealant made of resin or rubber that fills the gap between the liquid housing portion 15A (15B) and the electrolyte membrane 13A (13B), and may be durable against the metal solution LA (LB). The second elastic body 17A (17B) is disposed to surround the circumference of the opening 15*a* (15*b*). Accordingly, the metal solution LA (LB) can be enclosed in the liquid housing portion 15A (15B) and be allowed to contact the electrolyte membrane 13A (13B).

Examples of metal of the metal ions contained in the metal solution LA (LB) include copper, nickel, silver, and iron. The metal solution LA (LB) is an aqueous solution obtained by dissolving (ionizing) such metal in acids, such as nitric acid, phosphoric acid, succinic acid, sulfuric acid, or pyrophosphoric acid. For example, when metal of the metal film FA (FB) to be formed is nickel, the metal solution LA (LB) may be, for example, an aqueous solution of nickel nitrate, nickel phosphate, nickel succinate, nickel sulfate, or nickel pyrophosphate. Metal of the metal ions contained in each of the metal solutions LA and LB corresponds to the metal of each of the metal films FA and FB to be formed. Therefore, if metal of the metal film FA to be formed differs from that of the metal film FB to be formed, metal of the metal ions contained in the metal solution LA also differs from that contained in the metal solution LB.

The film forming apparatus 1 further includes a mount base 50 on which the first and second substrates SA and SB are adapted to be placed. The mount base 50 includes an electrically conductive portion 50*a* to be electrically coupled to the first substrate SA, and an electrically conductive portion 50*b* to be electrically coupled to the second substrate SB.

The film forming apparatus 1 further includes the power supply units 16A and 16B. The power supply unit 16A (16B) is adapted to apply a voltage across the anode 11A (11B) of the first film forming unit 10A (the second film forming unit 10B) and the first substrate SA (the second substrate SB) while the electrolyte membrane 13A (13B) is in contact with the first substrate SA (the second substrate SB) so that metal is deposited on the surface of the first substrate SA (the second substrate SB). Specifically, a positive electrode of the power supply unit 16A (16B) is coupled to the anode 11A (11B), and the negative electrode of the power supply unit 16A (16B) is coupled to the electrically conductive portion 50*a* (50*b*). Accordingly, a voltage can be applied across the anode 11A (11B) and the first substrate SA (the second substrate SB), and the first substrate SA (or the second substrate SB) can be allowed to function as a cathode.

In this manner, while the electrolyte membrane 13A (13B) of the film forming unit 10A (10B) is in contact with the first substrate SA (the second substrate SB), metal derived from metal ions with which the electrolyte membrane 13A (13B) is impregnated is deposited on the surface of the first substrate SA (SB). Although the film forming apparatus 1 is provided with two power supply units 16A and 16B corresponding to the first and second film forming units 10A and 10B in the present embodiment, a single power supply unit may be used to apply voltages across the anodes 11A and 11B of the first and second film forming units 10A and 10B and the first and second substrates SA and SB, respectively, for example.

The film forming apparatus 1 further includes a pressure device 20. The pressure device 20 includes a coupling portion 21 that couples the first and second film forming units 10A and 10B together, and a pressure unit 24 that pressurizes the first and second substrates SA and SB with the electrolyte membranes 13A and 13B of the first and second film forming units 10A and 10B, respectively, via the coupling portion 21.

The pressure unit 24 includes a pressure unit body 24*a*. The pressure unit body 24*a* is not particularly limited as long as it can move the coupling portion 21 toward the first and second substrates SA and SB and thus pressurize the first and second substrates SA and SB with the electrolyte membranes 13A and 13B, respectively. The pressure unit body 24*a* may be either a hydraulic or pneumatic actuator including a cylinder and a piston, or an electric actuator that moves up and down by means of a motor, for example. In the present embodiment, the pressure unit 24 includes a universal joint 24*b* attached to the distal end of the pressure unit body 24*a* in the pressurization direction, and also includes a support member 24*c* further attached to the distal end of the universal joint 24*b*.

In the present embodiment, the coupling portion 21 is coupled to the pressure unit 24. Each of the film forming units (the first film forming unit 10A or the second film forming unit 10B) is coupled to the coupling portion 21 via the first elastic body 30A (30B). The first elastic body 30A (30B) is adapted to elastically compressively deform in the pressurization direction of the pressure unit 24. In the present embodiment, the first elastic body 30A (30B) may be anything as long as it can elastically deform through compressive deformation, and may be rubber or a spring, for example. In the present embodiment, the first elastic body 30A (30B) is a spring, and the spring constant of the first elastic body 30A of the first film forming unit 10A has the same value as that of the first elastic body 30B of the second film forming unit 10B.

In the present embodiment, the spring constant of the first elastic body 30A (30B) in the pressurization direction is smaller than that of the second elastic body 17A (17B) in the pressurization direction. Accordingly, the first elastic body 30A (30B) can be compressively deformed more than the second elastic body 17A (17B).

Consequently, as illustrated in FIG. 1A, for example, when the distance between the electrolyte membrane 13A and the surface of the first substrate SA differs from the distance between the electrolyte membrane 13B and the surface of the second substrate SB before a pressure is applied, the difference d in the distance can be absorbed through compressive deformation of the first elastic bodies 30A and 30B. Further, the electrolyte membrane 13A (13B) of the film forming unit 10A (10B) can be allowed to follow the surface of the first substrate SA (the second substrate SB) through compressive deformation of the second elastic body 17A (17B). It should be noted that the compressive deformation of each of the first elastic body 30A (30B) and the second elastic body 17A (17B) is elastic deformation.

Further, in the present embodiment, as illustrated in FIG. 1B, the coupling portion 21 is pivotally attached to the pressure unit 24 so that when the first elastic bodies 30A and 30B have elastically deformed in response to a pressure applied by the pressure unit 24, the coupling portion 21 is caused to pivot due to the restoring forces of the first elastic bodies 30A and 30B.

Specifically, in the present embodiment, the coupling portion 21 is pivotally attached to the support member 24*c* of the pressure unit 24 via a pin 21*c* serving as the pivot center so that the coupling portion 21 pivots about the pressure unit 24. The first elastic bodies 30A and 30B are coupled to positions 21*a* and 21*b*, respectively, that sandwich the pin 21*c*. In the present embodiment, the first elastic bodies 30A and 30B may be coupled to the positions 21*a* and 21*b*, respectively, at which pressures applied to the first and second substrates SA and SB with the electrolyte membranes 13A and 13B of the first and second film forming units 10A and 10B, respectively, can be uniform (i.e., positions at which the pressures become closer levels). It should be noted that in the present embodiment, the pivoting range of the coupling portion 21 is limited to the range that allows for the maximum deformation amount of the first elastic body 30A (30B) at the position 21*a* (21*b*).

In the present embodiment, since the first and second film forming units 10A and 10B have the same structure, the distance from the position 21*a* coupling to the first elastic body 30A to the pin 21*c*, which serves as the pivot center, is equal to the distance from the position 21*b* coupling to the first elastic body 30B to the pin 21*c*.

In this manner, since the coupling portion 21 is pivotally attached to the pressure unit 24 as illustrated in FIG. 1A, even when the distance between the electrolyte membrane 13A and the first substrate SA differs from the distance between the electrolyte membrane 13B and the second substrate SB, the coupling portion 21 pivots by an amount corresponding to the difference d in the distance. Accordingly, the amounts of compressive deformation of the first elastic bodies 30A and 30B can be made closer to each other. Consequently, the pressures applied with the electrolyte membranes 13A and 13B of the first and second film forming units 10A and 10B, respectively, can be made more uniform.

2. Regarding a Method of Forming a Film Using the Film Forming Apparatus 1

Hereinafter, a method of forming a film using the film forming apparatus 1 according to the present embodiment will be described with reference to FIGS. 1A, 1B, and 2A to 2C.

First, as illustrated in FIG. 1A, the first and second substrates SA and SB are disposed on the mount base 50 so as to face the electrolyte membrane 13A of the first film forming unit 10A and the electrolyte membrane 13B of the second film forming unit 10B, respectively. Next, as illustrated in FIG. 1B, the coupling portion 21 is lowered toward the mount base 50 using the pressure unit 24.

In the present embodiment, in the state illustrated in FIG. 1A, the distance between the electrolyte membrane 13A and the first substrate SA is D, which is shorter than the distance between the electrolyte membrane 13B and the second substrate SB, and the difference in the distance is represented by d. Therefore, the coupling portion 21 is lowered first, and when the coupling portion 21 has been displaced by the distance D in the pressurization direction, the electrolyte membrane 13A of the first film forming unit 10A contacts the surface of the first substrate SA.

Figure 2A:
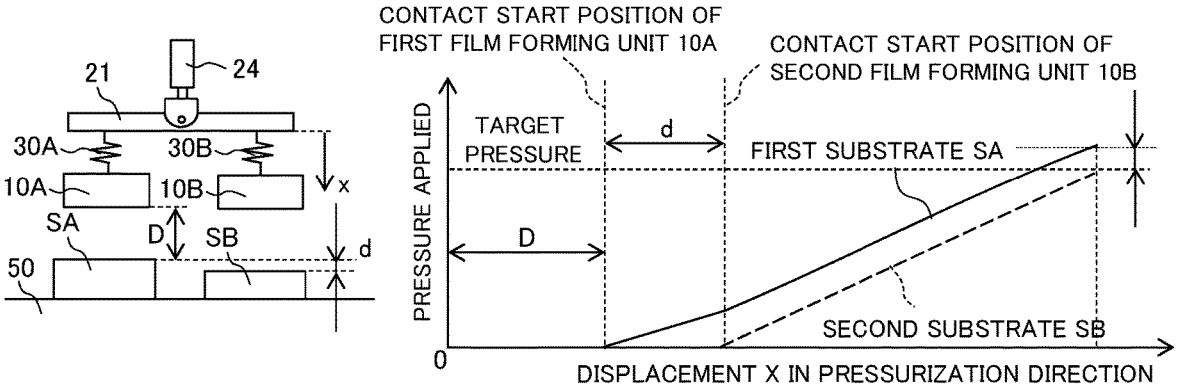
FIG. 2A illustrates the pressure of an electrolyte membrane of each of first and second film forming units of the film forming apparatus illustrated in FIG. 1B.

When the coupling portion 21 is further lowered toward the mount base 50, the first elastic body 30A and the second elastic body 17A of the first film forming unit 10A elastically deform in the pressurization direction, and the coupling portion 21 pivots about the pin 21*c*. This results in an increased pressure acting on the first substrate SA as illustrated in FIG. 2A.

When the coupling portion 21 is further lowered toward the mount base 50, the electrolyte membrane 13B of the second film forming unit 10B contacts the surface of the second substrate SB, and when the coupling portion 21 is even further lowered, the first elastic body 30B and the second elastic body 17B of the second film forming unit 10B elastically deform. Consequently, the pressures acting on the first and second substrates SA and SB are increased. In addition, the coupling portion 21 pivots by an amount corresponding to the amounts of compressive deformation of the first elastic bodies 30A and 30B.

In this manner, the first elastic bodies 30A and 30B of the first and second film forming units 10A and 10B individually elastically deform (i.e., compressively deform). Accordingly, the electrolyte membranes 13A and 13B of the first and second film forming units 10A and 10B can be individually displaced with respect to the single coupling portion 21 in the pressurization direction.

Consequently, the difference d between the distance between the electrolyte membrane 13A and the first substrate SA and the distance between the electrolyte membrane 13B and the second substrate SB can be absorbed through elastic deformation of the first elastic bodies 30A and 30B. Further, the surfaces of the first and second substrates SA and SB can be uniformly pressurized with the electrolyte membranes 13A and 13B of the first and second film forming units 10A and 10B, respectively.

Figure 2B:
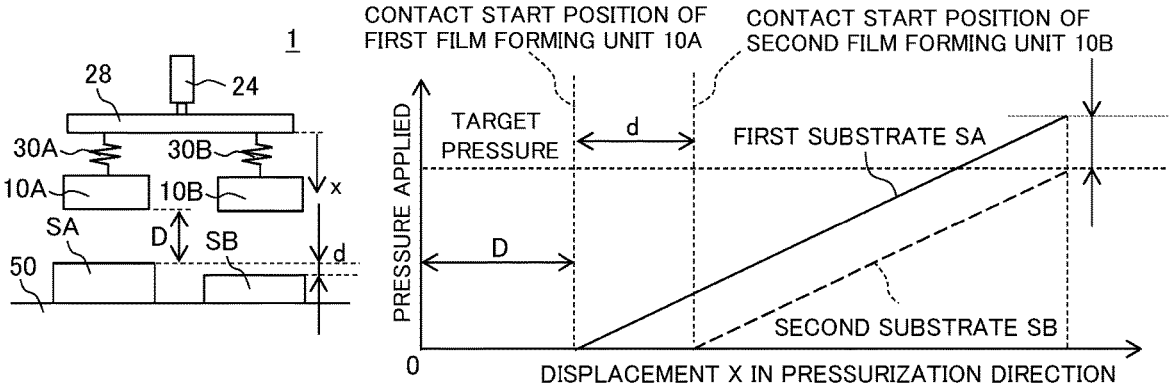
FIG. 2B illustrates the pressure of an electrolyte membrane of each of first and second film forming units of a film forming apparatus according to a modified example.
Figure 2C:
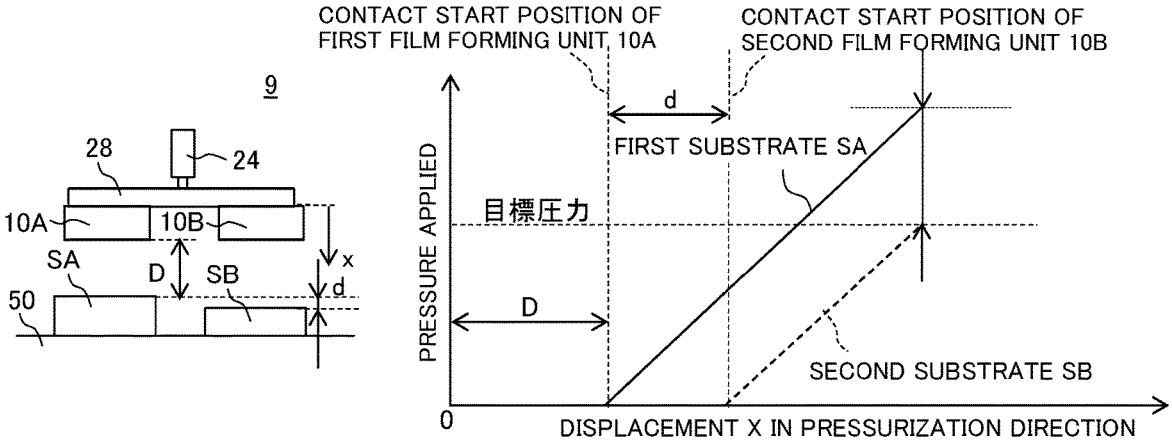
FIG. 2C illustrates the pressure of an electrolyte membrane of each of first and second film forming units of a film forming apparatus according to a comparative example.

Meanwhile, when the first elastic bodies 30A and 30B are not provided as in a film forming apparatus according to a comparative example illustrated in FIG. 2C, the difference d between the first and second film forming units 10A and 10B is absorbed only through compressive deformation of the second elastic bodies 17A and 17B that are sealants. Therefore, if the pressure acting on the second substrate SB has reached a target pressure as in a graph illustrated in FIG. 2C, the pressure acting on the first substrate SA becomes higher than that in the present embodiment illustrated in FIG. 2A.

Therefore, even in a film forming apparatus 1 according to a modified example in which the coupling portion is not pivotally attached to the pressure unit as illustrated in FIG. 2B unlike the film forming apparatus 1 illustrated in FIGS. 1A and 2A, the pressure acting on the first substrate SA can be made closer to the target pressure acting on the second substrate SB while a film is formed because the film forming apparatus 1 includes the first elastic bodies 30A and 30B.

In addition, in the present embodiment illustrated in FIGS. 1A and 2A, since the coupling portion 21 is pivotally attached to the pressure unit 24, the amounts of compressive deformation of the first elastic bodies 30A and 30B can be made closer to each other as the coupling portion 21 pivots by an amount corresponding to the aforementioned difference d in the distance. Consequently, the pressures applied with the electrolyte membranes 13A and 13B of the first and second film forming units 10A and 10B can be made more uniform.

Then, with such a pressurized state maintained, a voltage is applied across the anode 11A and the first substrate SA by the power supply unit 16A of the first film forming unit 10A, and a voltage is also applied across the anode 11B and the second substrate SB by the power supply unit 16B of the second film forming unit 10B. Since the electrolyte membranes 13A and 13B are in contact with the metal solutions LA and LB, respectively, the electrolyte membrane 13A and 13B contain metal ions, and the metal ions contained in the electrolyte membrane 13A and 13B are reduced on the surfaces of the first and second substrates SA and SB. This can form uniform metal films FA and FB on the respective surfaces of the first and second substrates SA and SB.

Hereinafter, the amounts of compressive deformation Δxr1 and Δxr2 of the first and second film forming units 10A and 10B and the fluid pressures p1 and p2 of the metal solutions LA and LB in the liquid housing portions 15A and 15B of the film forming apparatus 1 illustrated in FIG. 2B will be computed with reference to FIGS. 3A to 3D.

Herein, provided that the distance from the electrolyte membrane 13A of the first film forming unit 10A to the first substrate SA is D, and the distance from the electrolyte membrane 13B of the second film forming unit 10B to the second substrate SB is D+d, the displacement x of the coupling portion 21 in the pressurization direction is assumed to be zero. Hereinafter, the displacement x shall be referred to as a "displacement in the pressurization direction."

(A) When Displacement x in the Pressurization Direction≤Distance D

Figure 3A:
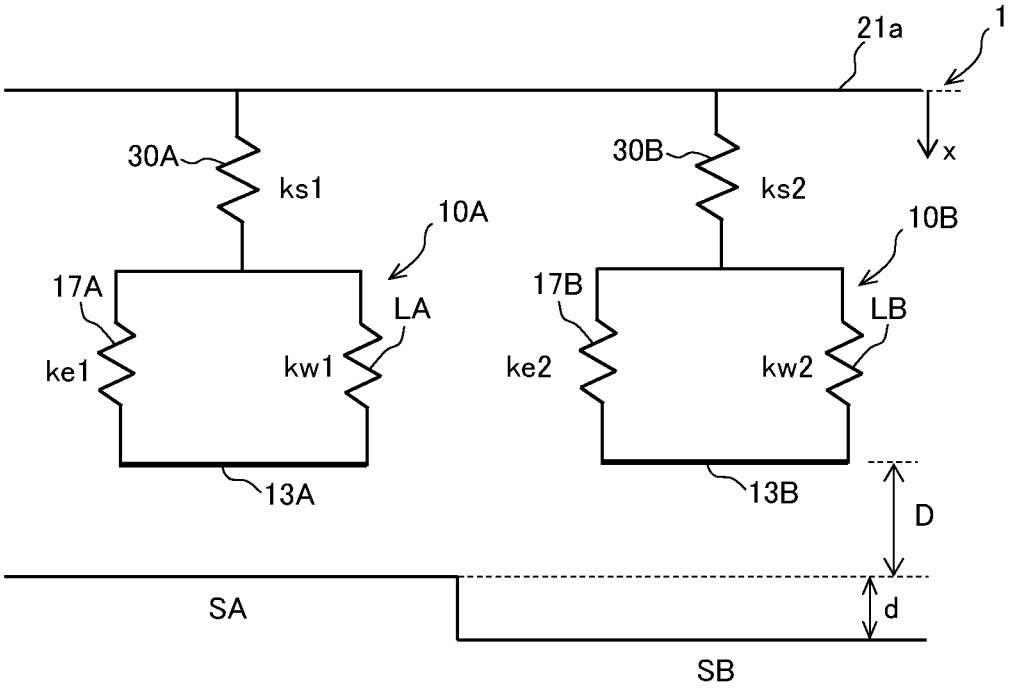
FIG. 3A is a model illustrating a state in which the first and second film forming units of the film forming apparatus illustrated in FIG. 2B are not in contact with first and second substrates, respectively.
Figure 3B:
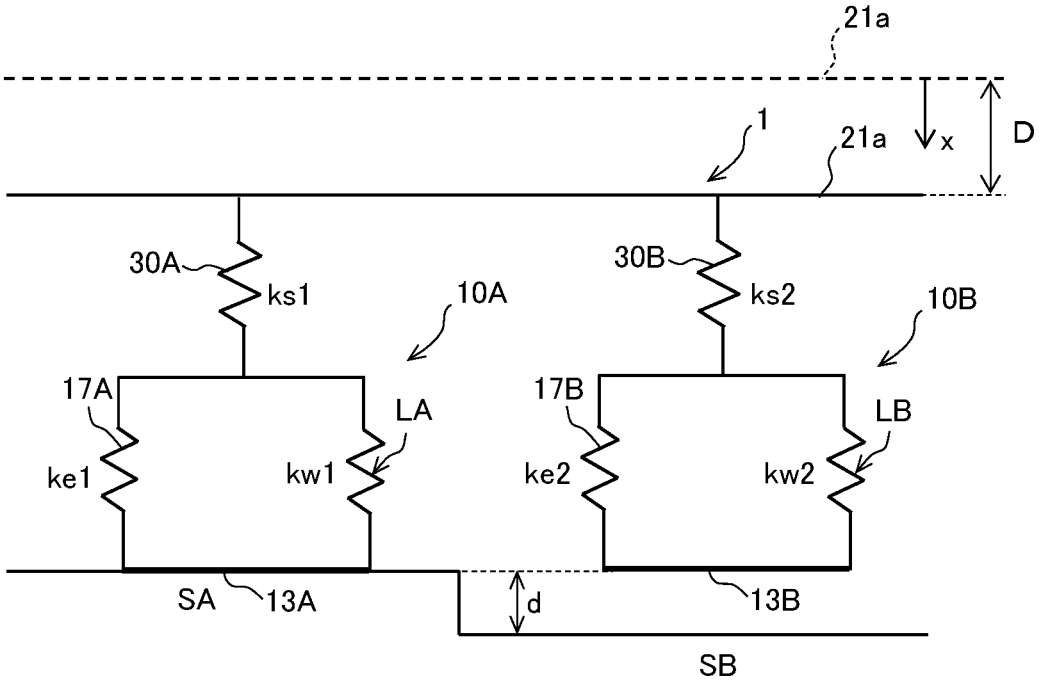
FIG. 3B is a model illustrating a state in which the electrolyte membrane of the first film forming unit starts contacting the first substrate from the state in FIG. 3A.

At this time, as illustrated in FIGS. 3A and 3B, neither the first film forming unit 10A nor the second film forming unit 10B of the film forming apparatus 1 pressurizes the first substrate SA or the second substrate SB. Therefore, at this time, no reaction force of the first or second substrate SA or SB acts on the film forming apparatus 1.

(B) When Distance D<Displacement x in the Pressurization Direction≤Distance D+d

Figure 3C:
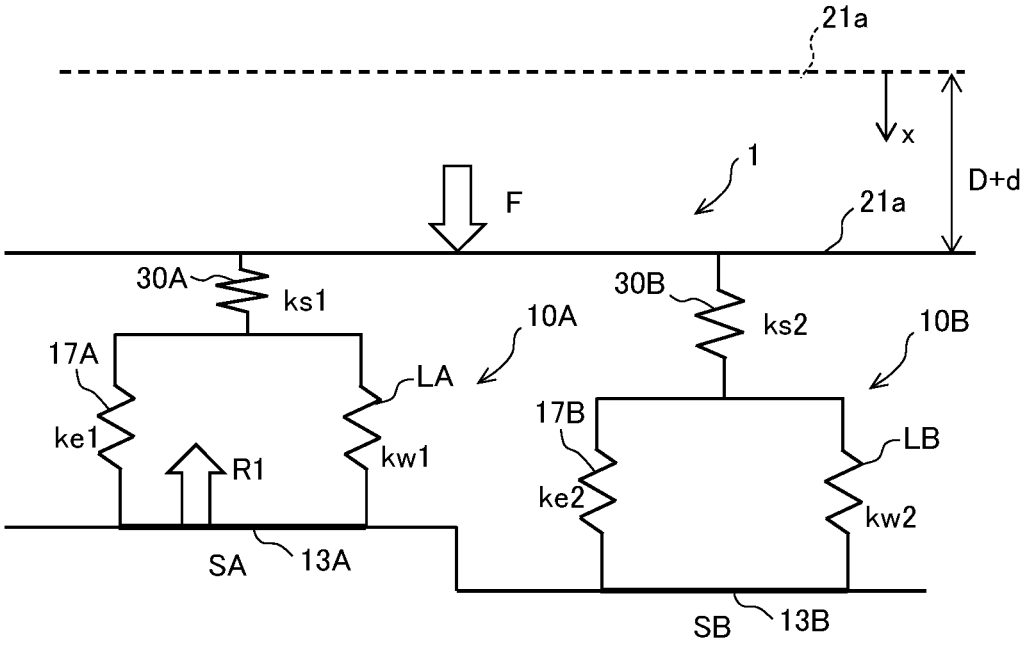
FIG. 3C is a model illustrating a state in which a first elastic body of the first film forming unit is compressively deformed from the state in FIG. 3B, and the electrolyte membrane of the second film forming unit starts contacting the second substrate.

At this time, the first film forming unit 10A pressurizes the first substrate SA, and the second film forming unit 10B is not in contact with the second substrate SB and thus does not pressurize the second substrate SB (i.e., a state in FIGS. 3B to 3C). Provided that the spring constant of the second elastic body 17A of the first film forming unit 10A is ke1, and the spring constant of the metal solution LA is kw1, they can be considered as parallel springs. Then, the spring constant ka1 of the combined spring can be represented as Formula (1) below. It should be noted that the value of the second elastic body 17A is the one computed from the compression modulus of elasticity of the material.

$$ka1=ke1+kw1 \tag{1}$$

Further, the first elastic body 30A and the combined spring can be considered as series springs. Provided that the spring constant of the first elastic body 30A is ks1, the spring constant kb1 of a combined spring, which includes the first elastic body 30A and the aforementioned combined spring, can be represented as Formula (2) below.

$$kb1 = \frac{ks1 \cdot ka1}{ks1 + ka1} \tag{2}$$

At this time, provided that the displacement of the coupling portion 21 in the pressurization direction from a time point when the electrolyte membrane 13A of the first film forming unit 10A contacts the first substrate SA is x, a pressure load F of the pressure unit 24 and a reaction force R1 of the first substrate SA acting on the electrolyte membrane 13A can be represented as Formula (3) below.

$$F=R1=kb1 \cdot x \tag{3}$$

Accordingly, provided that the area of the opening of the liquid housing portion 15A is Ar, the volume of the metal solution LA in the liquid housing portion 15A is Vr, and the modulus of volume elasticity of the metal solution LA is KW, the amount of compressive deformation Δxr1 of the first film forming unit 10A and the fluid pressure p1 of the metal solution LA in the liquid housing portion 15A can be represented as Formulae (4) and (5) below.

$$\Delta xr1 = R1 \cdot \frac{ks1 + ka1}{ks1 \cdot ka1} \cdot \left(1 - \frac{ka1}{ks1 + ka1}\right) \tag{4}$$

$$p1 = KW \cdot \frac{\Delta xr1 \cdot Ar}{Vr} \tag{5}$$

(C) When Displacement x in the Pressurization Direction>Distance D+d

Figure 3D:
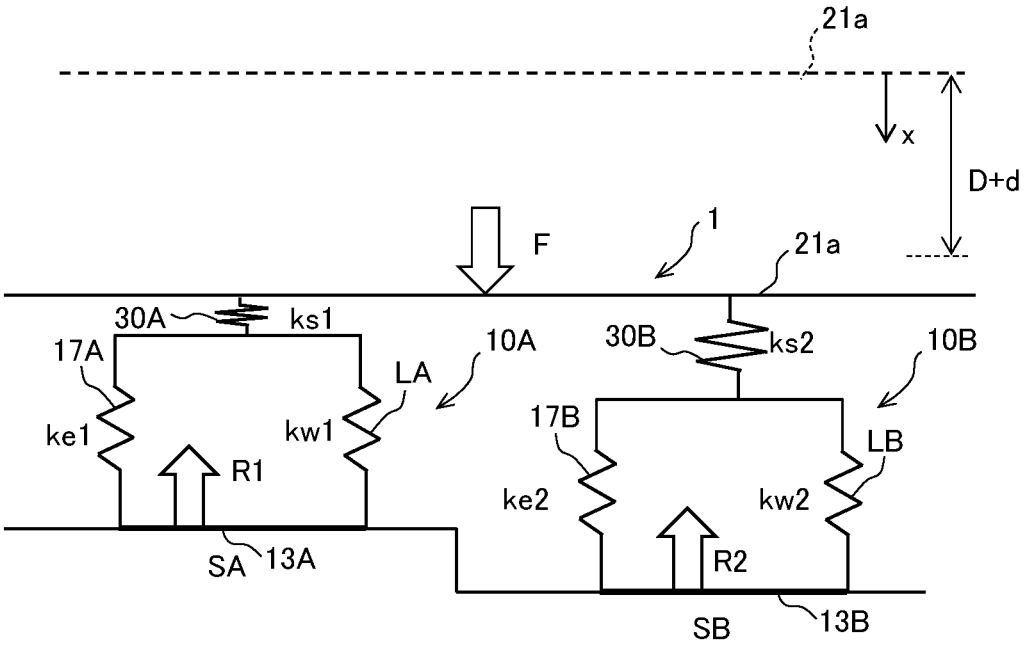
FIG. 3D is a model illustrating a state in which first elastic bodies of the first and second film forming units of the film forming apparatus illustrated in FIG. 2C are compressively deformed, and metal films are formed on the first and second substrates, respectively.

At this time, the first film forming unit 10A pressurizes the first substrate SA, and the second film forming unit 10B pressurizes the second substrate SB (i.e., a state in FIG. 3D). The pressure load F of the pressure unit 24 can be represented by Formula (6) below from the reaction force R1 of the first substrate SA acting on the electrolyte membrane 13A and a reaction force R2 of the second substrate SB acting on the electrolyte membrane 13B.

$$F=R1+R2 \tag{6}$$

Further, since a reaction force R1' generated after the second film forming unit 10B has contacted the second substrate SB is added to the formula on the right-hand side indicated by Formula (3), the reaction force R1 of the first substrate SA acting on the electrolyte membrane 13A can be represented as Formula (7) below.

$$R1=kb1\cdot x+R1' \tag{7}$$

Likewise, provided that the spring constant of the second elastic body 17B of the second film forming unit 10B is ke2, and the spring constant of the metal solution LB is kw2, they can be considered as parallel springs. Then, the spring constant ka2 of the combined spring can be represented as Formula (8) below.

$$ka2=ke2+kw2 \tag{8}$$

Further, the first elastic body 30B of the second film forming unit 10B and the combined spring can be considered as series springs. Provided that the spring constant of the first elastic body 30B is ks2, the spring constant kb2 of a combined spring, which includes the first elastic body 30B and the aforementioned combined spring, can be represented as Formula (9) below.

$$kb2=\frac{ks2\cdot ka2}{ks2+ka2} \tag{9}$$

From the Formulae above, the reaction force R1 of the first substrate SA acting on the electrolyte membrane 13A and the reaction force R2 of the second substrate SB acting on the electrolyte membrane 13B can be represented as Formulae (10) and (11) below.

$$R1=(F-F1)\cdot\left(\frac{ka2}{ka2+kb2}\right)+R1' \tag{10}$$

$$R2=(F-F1)\cdot\left(\frac{ka2}{ka2+kb2}\right) \tag{11}$$

From R1 and R2 computed from Formulae (10) and (11) and from ks1, ka1, ks2, and ka2 described above, the amounts of compressive deformation Δxr1 and Δxr2 of the first and second film forming units 10A and 10B and the fluid pressures p1 and p2 of the metal solutions L1 and L2 in the liquid housing portions 15A and 15B can be represented as Formulae (12) to (15) below. It should be noted that Formulae (12) and (4) are the same, and Formulae (13) and (5) are the same, but the values of R1 substituted into these formulae are different.

$$\Delta xr1=R1\cdot\frac{ks1+ka1}{ks1\cdot ka1}\cdot\left(1-\frac{ka1}{ks1+ka1}\right) \tag{12}$$

$$p1=KW\cdot\frac{\Delta xr1\cdot Ar}{Vr} \tag{13}$$

$$\Delta xr2=R2\cdot\frac{ks2+ka2}{ks2\cdot ka2}\cdot\left(1-\frac{ka2}{ks2+ka2}\right) \tag{14}$$

$$p2=KW\cdot\frac{\Delta xr2\cdot Ar}{Vr} \tag{15}$$

Figure 4:
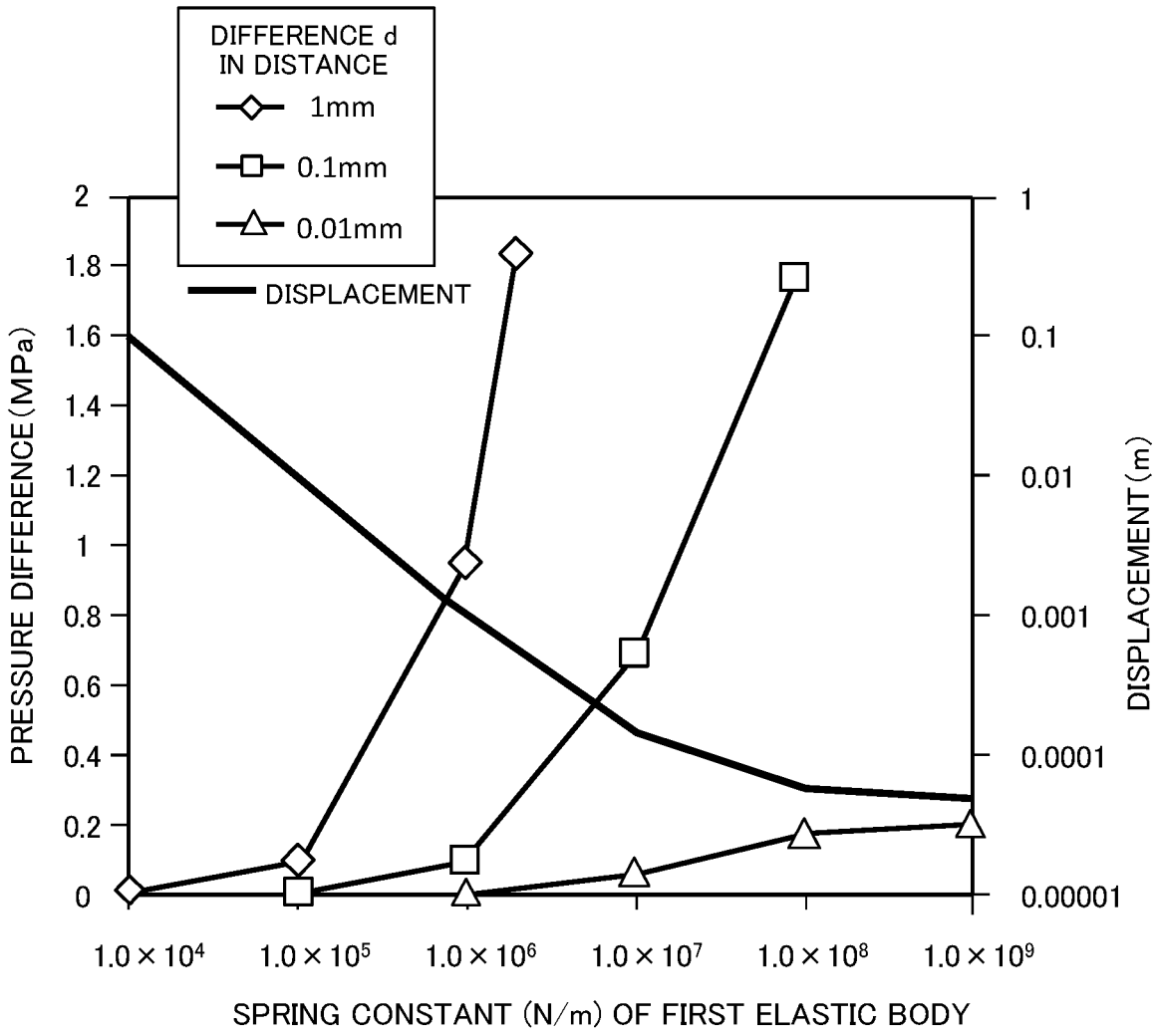
FIG. 4 is a graph of the relationship between the pressure difference between the pressures of the first and second electrolyte membranes and the amount of compressive deformation of the second film forming unit, with respect to the spring constants of the first elastic bodies of the first and second film forming units, which has been calculated from the model illustrated in FIG. 3D.

Herein, the spring constants of the first elastic bodies 30A and 30B were changed using Formulae (10) to (15), and the differential pressure (i.e., pressure difference) between the fluid pressures of the first and second film forming units 10A and 10B when the aforementioned difference d in the distance was changed was computed. Further, a displacement of each spring corresponding to the spring constant was also computed. FIG. 4 illustrates the results. The moduli of elasticity of the first elastic bodies 30A and 30B were set at the same value, the moduli of elasticity of the second elastic bodies 17A and 17B of the first and second film forming units 10A and 10B were set at the same value, and the moduli of elasticity of the metal solutions LA and LB were set at the same value.

As illustrated in FIG. 4, it was found that when the difference d is 1 mm, setting the spring constant of the first elastic body to less than or equal to $1.0\times10^4$ N/m can suppress the pressure difference to 0.1 MPa (i.e., suppress variations in the pressure difference to about 10%). However, if the spring constant is set further smaller, the displacement of the spring would exceed 0.1 m, which may not be preferable. Consequently, when the difference d in the distance is less than or equal to 1 mm, the spring constant of the first elastic body may be set to about $1.0\times10^4$ N/m.

Although the embodiments of the present disclosure have been described in detail above, the specific configuration is not limited thereto, and any design changes that are made within the spirit and scope of present disclosure are all included in the present disclosure.

In the present embodiment, as many film forming units as substrates on which films are to be formed are provided. Specifically, in the present embodiment, when films are concurrently formed on two respective substrates, two film forming units are coupled as film forming units to the coupling portion via their respective first elastic bodies. However, when films are concurrently formed on three or more substrates or when films are concurrently formed on three or more portions of a single substrate, three or more film forming units may be coupled correspondingly to the coupling portion via their respective first elastic bodies.

What is claimed is:

1. A film forming apparatus for forming a metal film on a surface of a substrate by reducing metal ions, comprising:

a plurality of film forming units each including an anode, an electrolyte membrane disposed between the anode and the substrate, and a liquid housing portion having the electrolyte membrane attached thereto, the liquid housing portion being adapted to house a metal solution containing the metal ions such that the metal solution is sealed in the liquid housing portion and the metal solution is in contact with the electrolyte membrane;

a pressure device including a coupling portion and a pressure unit, the coupling portion coupling the film forming units together, and the pressure unit pressurizing the substrates with the electrolyte membranes of the respective film forming units via the coupling portion; and a power supply unit adapted to apply a voltage across each anode and each substrate so that metal derived from the metal ions with which each electrolyte membrane is impregnated are deposited on a surface of the substrate in a state in which the electrolyte membrane of each film forming unit is in contact with the substrate, wherein:

each film forming unit is coupled to the coupling portion via a first elastic body, each of the first elastic bodies being adapted to elastically deform in a pressurization direction of the pressure unit;

wherein the coupling portion is joined to the pressure unit by a pin, and the plurality of film forming units are rotatable about the pin; and wherein the coupling portion is pivotally attached to the pressure unit so that the coupling portion pivots when each first elastic body has elastically deformed in response to a pressure applied by the pressure unit.

2. The film forming apparatus for forming a metal film according to claim 1, wherein:

the electrolyte membrane is attached to the liquid housing portion via a second elastic body, the second elastic body being adapted to elastically deform in the pressurization direction, and a spring constant of the first elastic body in the pressurization direction is smaller than that of the second elastic body in the pressurization direction.

* * * * *